US012674393B1

(12) United States Patent
Shim et al.

(10) Patent No.: US 12,674,393 B1
(45) Date of Patent: Jul. 7, 2026

(54) PROPELLER ASSEMBLY

(71) Applicant: PARTS KOREA Co., Ltd, Haman-gun (KR)

(72) Inventors: Chang Su Shim, Changwon-si (KR); Kwang Nam Kim, Busan (KR)

(73) Assignee: PARTS KOREA Co., Ltd, Haman-gun (KR)

( * ) Notice: Subject to any disclaimer, the term of this patent is extended or adjusted under 35 U.S.C. 154(b) by 0 days.

(21) Appl. No.: 19/063,364

(22) Filed: Feb. 26, 2025

(30) Foreign Application Priority Data

Feb. 10, 2025 (KR) ..... 10-2025-0016853

(51) Int. Cl.

| | |
|---|---|
| ***F01D 5/02*** | (2006.01) |
| ***B63H 23/34*** | (2006.01) |
| ***F04D 29/20*** | (2006.01) |
| ***F04D 29/26*** | (2006.01) |

(52) U.S. Cl.
CPC ..... *F01D 5/021* (2013.01); *B63H 23/34* (2013.01); *F01D 5/025* (2013.01); *F04D 29/20* (2013.01); *F04D 29/263* (2013.01)

(58) Field of Classification Search
CPC ..... F01D 5/021; F01D 5/025; F04D 29/20; F04D 29/263; B63H 23/34
See application file for complete search history.

(56) References Cited

U.S. PATENT DOCUMENTS

| | | | | |
|---|---|---|---|---|
| 6,354,802 | B1 * | 3/2002 | Neisen | B63H 23/34 416/135 |
| 11,745,842 | B1 * | 9/2023 | Powers | B63H 1/20 440/49 |
| 2003/0118443 | A1 * | 6/2003 | Chen | B63H 23/34 416/134 R |
| 2008/0096446 | A1 * | 4/2008 | Lin | B63H 23/34 440/83 |
| 2008/0139061 | A1 * | 6/2008 | Chen | F16D 9/06 440/78 |
| 2009/0163089 | A1 * | 6/2009 | Chen | F16C 3/02 440/49 |
| 2016/0195183 | A1 * | 7/2016 | Matsuda | F16C 19/364 464/97 |

FOREIGN PATENT DOCUMENTS

KR 10-2449486 B1 9/2022

* cited by examiner

*Primary Examiner* — Nathaniel E Wiehe
*Assistant Examiner* — Theodore C Ribadeneyra
(74) *Attorney, Agent, or Firm* — Paratus Law Group, PLLC

(57) ABSTRACT

A propeller assembly, includes: a shaft having a cylindrical shape and connected to the drive shaft of a motor; a thrust washer provided on the outer surface of the shaft; a hub provided on the outer surface of the shaft, with a thrust washer arranged on one side and multiple ribs protruding from its outer surface; a bushing formed on the outer surface of the hub, having a polygonal column shape; a propeller provided on the outer surface of the bushing, with multiple blades arranged to generate thrust; and an after spacer provided on the outer surface of the shaft, positioned on one side to secure the propeller.

4 Claims, 3 Drawing Sheets

A

B

PROPELLER ASSEMBLY

CROSS-REFERENCE TO RELATED APPLICATION

The present application claims priority to Korean Patent Application No. 10-2025-0016853 (filed Feb. 10, 2025), which is hereby incorporated by reference in its entirety.

BACKGROUND

The present invention relates to a propeller assembly and, more specifically, to a propeller assembly in which the ribs of the hub are designed to break first when the propeller experiences an impact, thereby minimizing the shock transmitted to the engine.

A propeller is a key component used to generate thrust in aircraft, ships, drones, and certain industrial machines. It is typically composed of multiple blades that push air or water to create forward or rotational force. Structurally, a propeller consists of a hub and blades, where the hub is directly connected to the engine, and the blades rotate to generate thrust.

Additionally, the hub is the central structural component that connects the propeller blades to the engine or drive shaft, playing a crucial role in maintaining balanced rotation of the propeller. Generally, the hub is designed with a specific breaking strength to protect the engine in the event of a strong impact. In other words, the ribs of the hub are designed to break first when an impact occurs, thereby preventing direct damage to the engine.

An important factor in the design of the hub is the adjustment of the rib strength. If the ribs are too weak, they may break unnecessarily quickly, whereas if they are too strong, external impacts may be directly transmitted to the engine, potentially causing severe damage.

Related Art: Korean Registered Patent No. 10-2449486

SUMMARY

To address the aforementioned problem, the objective of the present invention is to provide a propeller assembly in which the ribs of the hub are designed to break first when the propeller experiences an impact.

To achieve the aforementioned objective, the propeller assembly of the present invention comprises: a shaft having a cylindrical shape and connected to the drive shaft of a motor; a thrust washer provided on the outer surface of the shaft; a hub provided on the outer surface of the shaft, with a thrust washer arranged on one side and multiple ribs protruding from its outer surface; a bushing formed on the outer surface of the hub, having a polygonal column shape; a propeller provided on the outer surface of the bushing, with multiple blades arranged to generate thrust; and an after spacer provided on the outer surface of the shaft, positioned on one side to secure the propeller.

Wherein the thrust washer has a cylindrical shape and includes a recessed portion formed concavely on its outer surface.

Wherein the hub has an outer surface formed in a rectangular column shape, and a pair of right-angled triangular ribs are provided in contact with the edges of the hub.

Wherein multiple ribs are formed in the longitudinal direction of the hub.

Wherein the outer surface of the bushing has an octagonal column shape and is made of a rubber material.

The propeller assembly according to the present invention has the following effects.

When the propeller is impacted, the ribs break first, minimizing the impact on the engine.

In addition, even if the ribs are damaged, the elasticity of the bushing allows the rotational force of the shaft to be transmitted to the propeller, enabling low-speed operation.

Furthermore, the thrust washer is concavely shaped, preventing nets or fishing lines from getting entangled and stuck on the shaft, instead allowing them to wrap around the thrust washer.

DETAILED DESCRIPTIONS

Figure 1:
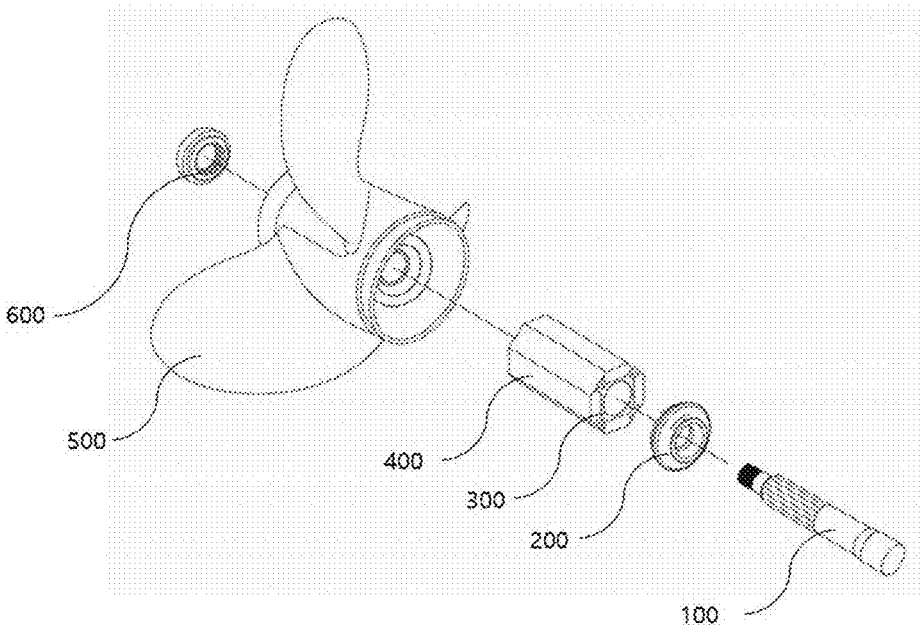
FIG. 1 is an exploded perspective view showing a propeller assembly according to the present invention.
Figure 2:
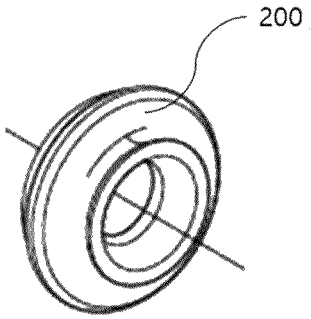
FIG. 2: A is a perspective view of the thrust washer, and B is a side view.
Figure 2:
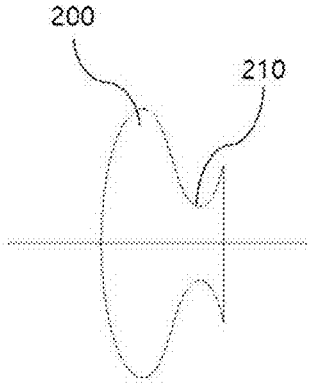

Hereinafter, a preferred embodiment of the propeller assembly according to the present invention will be described in detail with reference to the accompanying drawings.

The propeller assembly of the present invention comprises: a shaft (100) having a cylindrical shape and connected to the drive shaft of a motor; a thrust washer (200) provided on the outer surface of the shaft (100); a hub (300) provided on the outer surface of the shaft (100), with a thrust washer (200) arranged on one side and multiple ribs (310) protruding from its outer surface; a bushing (400) formed on the outer surface of the hub (300), having a polygonal column shape; a propeller (500) provided on the outer surface of the bushing (400), with multiple blades arranged to generate thrust; and an after spacer (600) provided on the outer surface of the shaft (100), positioned on one side to secure the propeller (500).

First, the shaft is provided. The shaft (100) is formed in a cylindrical shape and is connected to the drive shaft of a motor (not shown). The shaft (100) transmits the rotational force of the motor and serves as the central axis on which all the components described below are mounted.

A thrust washer (200) is provided on the outer surface of the shaft (100). The thrust washer (200) has a cylindrical shape, with its radius decreasing toward one side. Additionally, the outer surface of the thrust washer (200) is concavely formed, creating a recessed portion (210). This design prevents fishing nets or fishing lines from penetrating and getting entangled between the shaft (100) and the thrust washer (200). Instead, it guides them to wind around the recessed portion (210), thereby preventing them from becoming stuck on the shaft (100).

Additionally, the thrust washer (200) prevents the components described below from becoming loose and protects them from damage.

The thrust washer (200) may be made of stainless steel, but is not limited thereto.

A hub (300) is provided on the outer surface of the shaft (100). The hub (300) is positioned on the opposite side of the thrust washer (200). Additionally, the outer surface of the hub (300) is formed in a rectangular column shape, and multiple ribs (310) protrude from its outer surface.

Figure 5:
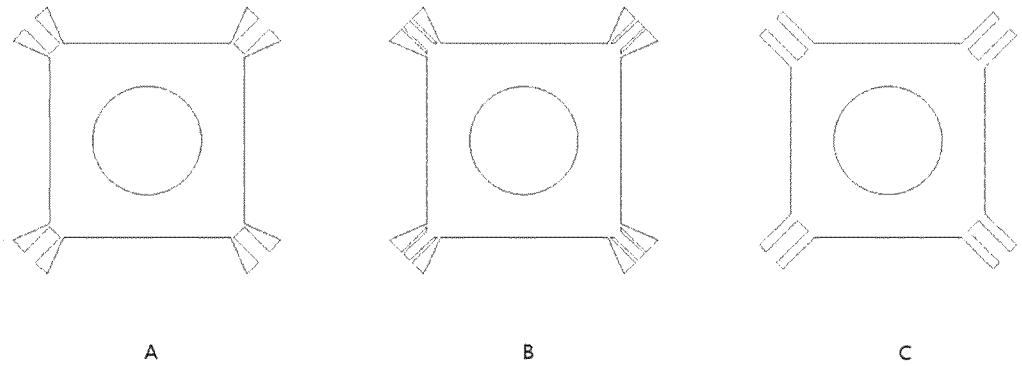
FIG. 5 is a front view of the hub, illustrating different embodiments.

In one embodiment, as shown in FIG. 5A, the ribs (310) are formed in a triangular shape in contact with the edges of the hub (300). More preferably, the ribs (310) may be formed as a pair of right-angled triangles.

Figure 3:
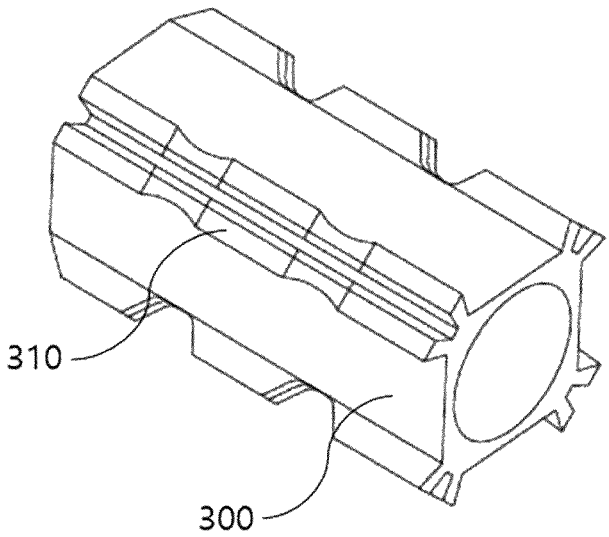
FIG. 3 is a perspective view of the hub.

Additionally, the ribs (310) are arranged at equal intervals along the longitudinal direction of the hub (300) and are provided in multiple numbers. Specifically, as shown in FIG. 3, it is preferable that a total of 24 ribs (310) are provided, but it is not limited thereto.

In another embodiment, as shown in FIG. 5B, the ribs (310) are provided in a triangular shape in contact with the edges of the hub (300). More preferably, the ribs (310) may be formed as a pair of right-angled triangles. Additionally, rectangular ribs (310) may be further provided between the different ribs (310).

Additionally, the ribs (310) are arranged at equal intervals along the longitudinal direction of the hub (300) and are provided in multiple numbers. Specifically, it is preferable that a total of 36 ribs (310) are provided, but it is not limited thereto.

In another embodiment, as shown in FIG. 5C, the ribs (310) are provided in a rectangular shape in contact with the edges of the hub (300). More preferably, the ribs (310) may be formed as a pair.

Additionally, the ribs (310) are arranged at equal intervals along the longitudinal direction of the hub (300) and are provided in multiple numbers. Specifically, it is preferable that a total of 24 ribs (310) are provided, but it is not limited thereto.

When the propeller (500), which will be described below, is damaged due to an external impact, the impact may be transmitted to the motor through the shaft (100). To prevent this, the ribs (310) are designed in a shape that absorbs impact and easily fractures. This helps to minimize the impact transmitted to the motor. In this case, only the fractured hub (300) can be replaced and reused.

Here, the hub (300) and the ribs (310) may be made of stainless steel or aluminum, but are not limited thereto.

A bushing (400) is provided on the outer surface of the hub (300). The inner surface of the bushing (400) is designed to have the same shape as the outer surface of the hub (300), allowing the bushing (400) to be fitted onto the hub (300). Additionally, the bushing (400) is formed in a polygonal column shape on its outer surface.

Figure 4:
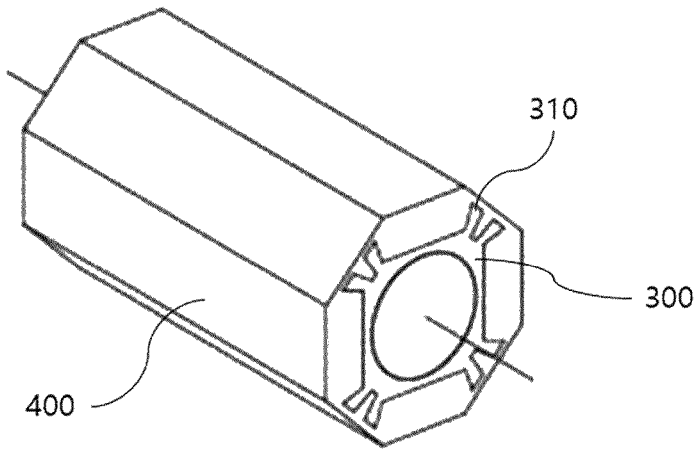
FIG. 4 is a perspective view showing the combination of the hub and the bushing.

Specifically, as shown in FIG. 4, it is preferable that the outer surface of the bushing (400) is shaped as an octagonal column. This ensures that the propeller (500), which will be described below, does not slip and can rotate together with the hub (300).

Additionally, it is preferable that the bushing (400) is made of an elastic material, with rubber being particularly desirable. As a result, if the ribs (310) are damaged, normal operation may not be possible. However, since the bushing (400) has elasticity, some of the rotational force of the shaft (100) can still be transmitted to the propeller (500), which will be described below, at low speeds, allowing for limited low-speed operation.

The propeller (500) is provided on the outer surface of the bushing (400). The inner surface of the propeller (500) is designed to have the same shape as the outer surface of the bushing (400), allowing the propeller (500) to be fitted onto the bushing (400). As a result, the propeller (500) can receive rotational force from the shaft (100) and rotate accordingly.

Additionally, to generate thrust as the propeller (500) rotates, multiple blades are formed on the outer surface of the propeller (500).

An after spacer (600) is provided on the outer surface of the shaft (100). The after spacer (600) is positioned on the opposite side of the propeller (500). Specifically, the after spacer (600) serves to secure the propeller (500) located on one side of the after spacer (600).

The after spacer (600) secures the propeller (500) at the end of the shaft (100), preventing the propeller (500) from being pushed outward along the shaft (100). Additionally, in the assembled state, the after spacer (600) compresses all components, enhancing the structural stability of the invention and reducing vibrations.

The operation of the propeller (500) assembly according to the present invention is described below.

First, the thrust washer (200) is installed on the shaft (100) connected to the motor. Next, the assembly consisting of the bushing (400), hub (300), and propeller (500) is installed on the opposite side of the thrust washer (200). Finally, the after spacer (600) is used to secure the propeller (500) in place.

When the propeller (500) is subjected to an external impact, the ribs (310) are the first to fracture. This design helps absorb the impact, thereby minimizing the shock transmitted to the motor.

At this point, normal operation becomes difficult. However, since the hub (300) is made of an elastic material, some of the rotational force from the shaft (100) is still transmitted to the propeller (500) at low speeds. This allows for low-speed operation, enabling the vessel to be safely moved to a secure location.

As described above, the technical configuration of the present invention can be understood by those skilled in the art to which the invention pertains as being capable of being implemented in other specific forms without altering its technical spirit or essential characteristics.

Therefore, the embodiments described above should be understood as illustrative rather than limiting in all aspects. The scope of the present invention is defined by the following claims rather than the detailed description, and all modifications or variations derived from the meaning and scope of the claims and their equivalents should be interpreted as being included within the scope of the present invention.

DETAILED DESCRIPTION OF MAIN ELEMENTS

100: shaft 200: thrust washer
210: recessed portion 300: hub
310: rib 400: bushing
500: propeller 600: afterspacer

The invention claimed is:

1. A propeller assembly comprising:

a shaft configured to be connected to a drive shaft of a motor;

a thrust washer disposed on an outer surface of the shaft;

a hub disposed on the outer surface of the shaft adjacent to the thrust washer, the hub including multiple ribs protruding from an outer surface of the hub, wherein each rib has a bottom portion connected to the hub, the bottom portion having a thickness less than or equal to a thickness of opposite portion of corresponding rib such that the multiple ribs are configured to fracture upon external impact so as to minimize transmission of shock to the motor;

a bushing disposed on the outer surface of the hub, the bushing having a polygonal column shape;

a propeller provided on an outer surface of the bushing, with multiple blades arranged to generate thrust; and an after spacer provided on the outer surface of the shaft, positioned on one side to secure the propeller, wherein the thrust washer has a cylindrical shape and includes a first side facing the hub, a second side opposite to the first side, and a recessed portion formed concavely on the second side, wherein a thickness of the thrust washer is reduced at the recessed portion and increases again toward an outer end of the second side such that the recessed portion is configured to prevent fishing lines or nets from entangling between the shaft and the thrust washer.

2. The propeller assembly according to claim 1, wherein the hub has an outer surface formed in a polygonal column shape, and the multiple ribs include a pair of ribs arranged along each edge of the hub.

3. The propeller assembly according to claim 1, wherein the multiple ribs are arranged in a longitudinal direction of the hub.

4. The propeller assembly according to claim 1, wherein the bushing is made of a rubber material being configured to transmit torque to the propeller even when the multiple ribs are fractured so as to allow limited operation.

* * * * *